United States Patent [19]

Knippel

[11] 4,213,725

[45] Jul. 22, 1980

[54] DOUBLE LOCKING DOOR LATCH MECHANISM FOR RAILWAY HOPPER CARS

[75] Inventor: Willis H. Knippel, Palos Park, Ill.

[73] Assignee: Pullman Incorporated, Chicago, Ill.

[21] Appl. No.: 954,791

[22] Filed: Oct. 25, 1978

[51] Int. Cl.[2] ..... B61D 7/30; B65G 67/24

[52] U.S. Cl. ..... 414/387; 105/241.2; 292/216; 298/35 R

[58] Field of Search ..... 414/387, 376, 144, 145; 105/241 C, 308 R, 308 P, 308 B, 310; 298/33, 34, 35 R, 35 M; 292/216, 227, 224, 221

[56] References Cited

U.S. PATENT DOCUMENTS

| | | | |
|---|---|---|---|
| 1,175,165 | 3/1916 | Morey | 105/310 |
| 2,686,479 | 8/1954 | Shields et al. | 414/387 X |
| 2,686,605 | 8/1954 | Kepner | 414/387 |
| 3,905,627 | 9/1975 | Fujita | 292/216 |
| 4,051,960 | 10/1977 | Raksanyi | 414/387 |
| 4,158,996 | 6/1979 | Marulic et al. | 105/308 R |

*Primary Examiner*—Robert G. Sheridan
*Assistant Examiner*—Edmond G. Rishell, Jr.
*Attorney, Agent, or Firm*—Stephen D. Geimer

[57] ABSTRACT

A hopper car door locking mechanism includes a rotatable latch member which includes a keeper receiving portion. The latch member also includes a positioning portion providing stops which are engaged by a rotatable locking pawl in the closed position of the hopper car door. The rotatable locking pawl includes a cam device which is pivoted in response to reciprocating movement of a rod having a suitable cam surface. The rod also includes a stop device which with the rotatable latch member provides a second stop which therefore provides for double locking of the door.

10 Claims, 9 Drawing Figures

DOUBLE LOCKING DOOR LATCH MECHANISM FOR RAILWAY HOPPER CARS

BACKGROUND OF THE INVENTION

1. Field of the Invention

The present invention relates to the field of railway hopper cars having side discharge openings. More specifically the invention relates to an improved locking device for a hopper car door which provides for double locking of the door in the closed position and which is ground actuated to release the doors to their open position.

2. Description of the Prior Art

The patent pertinent to the present invention is Morey, U.S. Pat. No. 1,175,165. The present construction is an improvement over the aforementioned patent.

SUMMARY OF THE INVENTION

In the present construction the hopper car includes hinged side doors which are moved by gravity to their open position upon the release of a novel locking mechanism. A plurality of latch mechanisms are suitably supported underneath the hopper adjacent to the discharge opening of the car, each of the latch mechanisms including a housing having pivotally supported thereon pivoted latch members which are adapted to receive in keeper engaging recesses the keeper members which are supported on the door structures. Each of the latch members is provided with a keeper engaging portion at one end and with a latch positioning portion at the other end. The latch members are rotatably supported and include spaced stops provided on an arcuate positioning surface. A pawl is also provided on each of the stop mechanisms and is hingedly movable to engage a stop provided on the positioning surface to maintain the latch members in their closed engaged and locking position relative to the keeper members of the door. The pawls of each of the latch mechanisms are provided with outwardly projecting tongues or cam members which ride on cam surfaces provided by horizontally movable plates. Each of the plates also is provided with a stop portion which also, in the closed position of the latch members, engages another stop provided on the positioning surface of each latch member. Thus the pivoted pawl and the longitudinally reciprocal cam containing member provide for a double locking action of the latch member in its closed position. Upon movement of the camming actuating member the cam rides on the cam surface provided to a position wherein the stop on the pawl is disengaged from the stop provided on the positioning surface of the latch member. Simultaneously, as the camming member is reciprocated to the disengaging position the stop provided on this member is also released from the positioning surface stop so that now the latch member is free to move to the open position whereupon the keeper member is disengaged from locking relation.

The camming and actuating element is moved by a driven mechanism provided on the lower surface of the center sill of the car the said driven mechanism being engageable by a drive unit or actuating mechanism which may be positioned between the tracks of the car on the ground surface. Thus the drive mechanism functions to cause operation of the driven mechanism which in turn includes linkage which is connected to the camming elements of the assembly for moving the same between their open and closed positions. When the car has been dumped and it is desired to again close the door mechanisms the car is moved along the track and closing cams engage each of the doors swinging them to their closed position whereupon the stop members between the pawl, camming member, and the stop on the positioning surface are again re-engaged and the unit again is locked and the mechanism again is locked in the closed position.

DESCRIPTION OF THE PREFERRED EMBODIMENT

Figure 1:
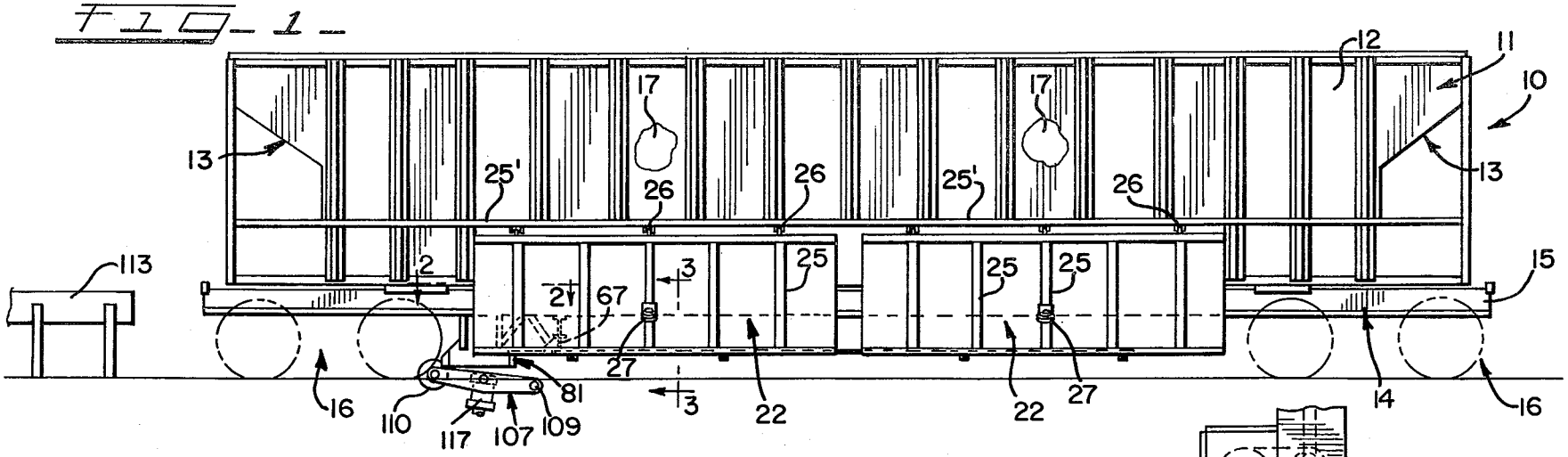
FIG. 1 is a side elevational view of a railway hopper car.

Referring to the drawings a railway hopper car 10 includes a car body 11 including side walls 12 and end walls 13. The body 11 is supported on a car underframe 14 including a center sill 15. Suitable bolsters (not shown) support the body on wheel trucks 16. The present car disclosed is of the open top type and includes longitudinally spaced structure 17 which are adapted to discharge material downwardly and sidewardly from the hopper on opposite sides of the car, each of the hopper structures comprising a pair of door openings and doors. Hopper structures 17 include slope sheets 18 and hopper walls 21 providing at their lower end discharge openings 19. The hopper structures are suitably supported by cross bearer supports 20 which extend in longitudinally spaced relation and being supported by the center sill 15 of the car. Doors 22 are connected on opposite sides of the car to the side walls 12. Each door 22 comprises load carrying plate members 23 having connected thereto at opposite ends thereof Z-shaped longitudinally extending members 24 which are connected to the plate members 23 and reinforced by reinforcing stiffeners 25. The doors 22 are connected to the side sills 25' of the car by means of longitudinally spaced hinged brackets 26 as best shown in FIG. 1. Each of the doors 22 has connected thereto on the outer surface thereof cam follower wheels 27.

Figure 3:
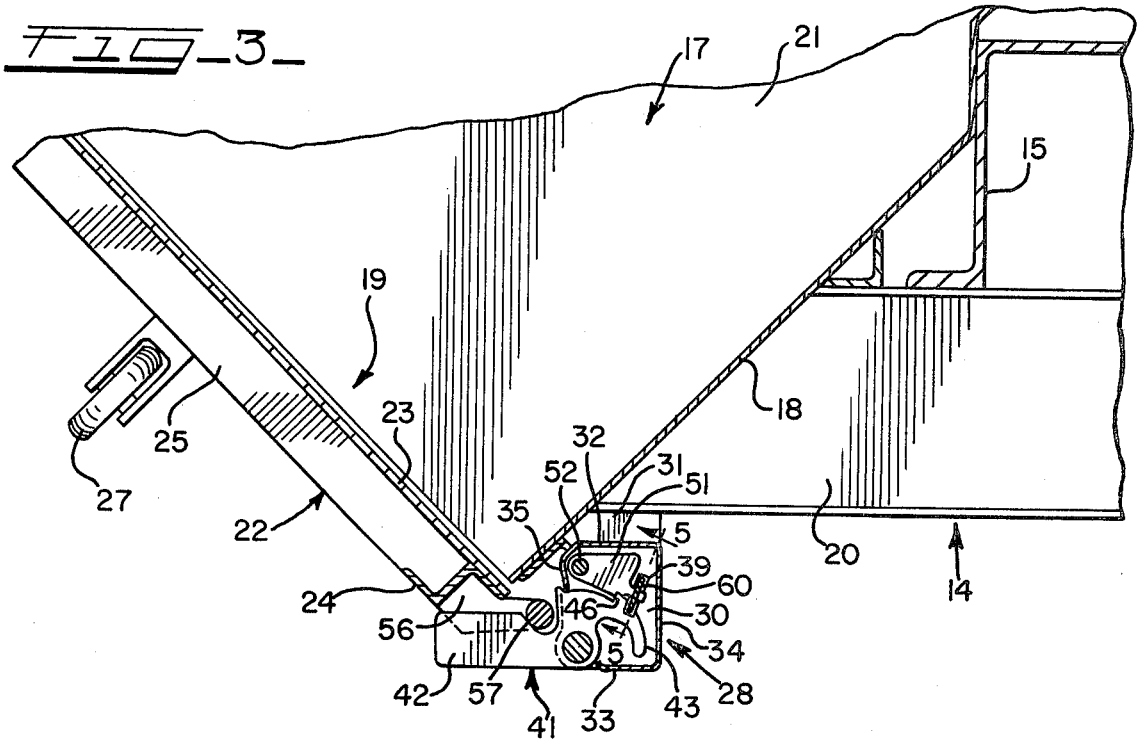
FIG. 3 is a cross-sectional view taken substantially along the line 3—3 of FIG. 1 disclosing a latching mechanism for hopper car doors.
Figure 5:
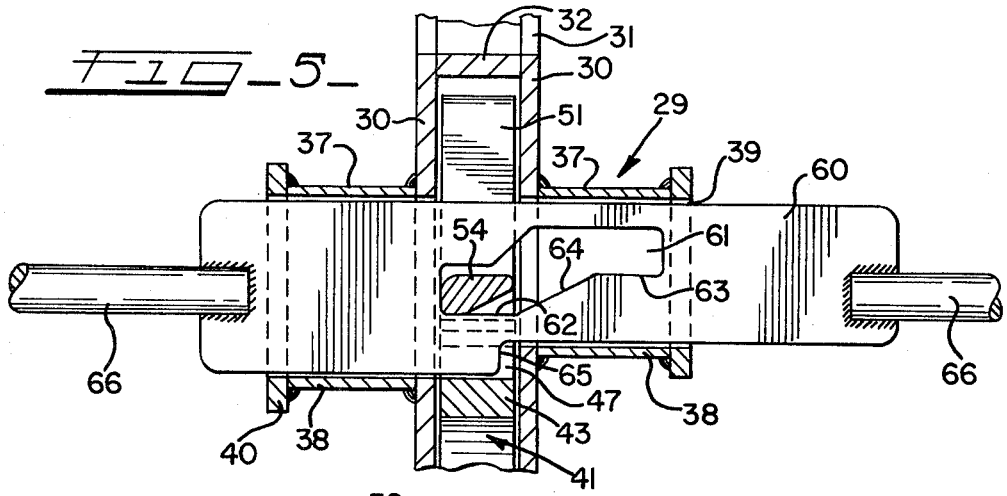
FIG. 5 is a cross-sectional view taken substantially along the line 5—5 of FIG. 3 showing one position of a latch mechanism and actuating means therefor.
Figure 6:
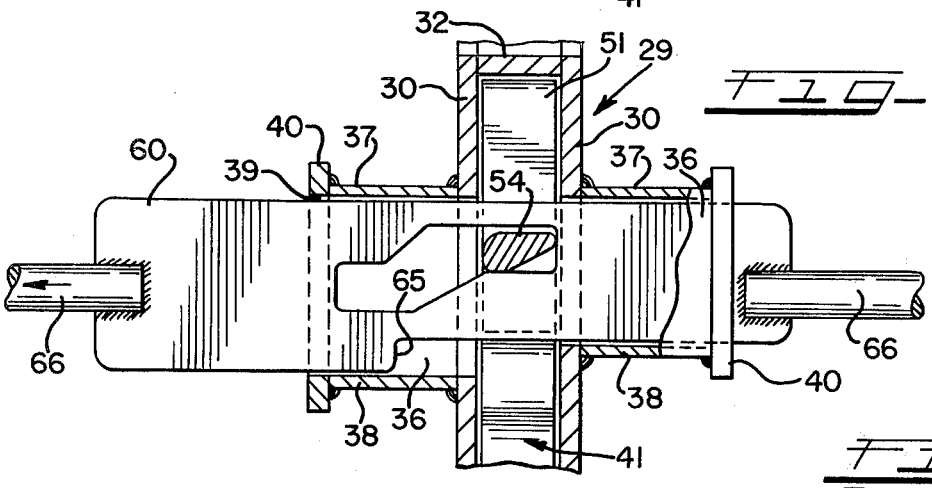
FIG. 6 is a view similar to FIG. 5 showing another position of the mechanism.

Each of the doors may be suitably locked in a locked position by two or more door locking mechanisms generally designated by reference character 28. Each of the locking mechanisms 28 includes a housing or lock support bracket 29 suitably carried on the lower bottom end of the hopper structure 17 and also being connected to the cross bearer supports 20 immediately adjacent to the mechanism 28. As best shown in FIGS. 5 and 6, each door locking mechanism 28 includes a housing 29 comprising horizontally spaced vertical plates 30 which at their upper ends include upper securing extensions 31 suitably connected to the underneath surface of the cross bearer supports 20. As best shown in FIGS. 3, 5 and 6 the housing also includes upper and lower horizontal walls 32 and 33, respectively. A vertical transverse wall 34 connects the walls 32 and 33. As best shown in FIG. 3 the housing also includes a downwardly extending short wall portion 35.

Figure 4:
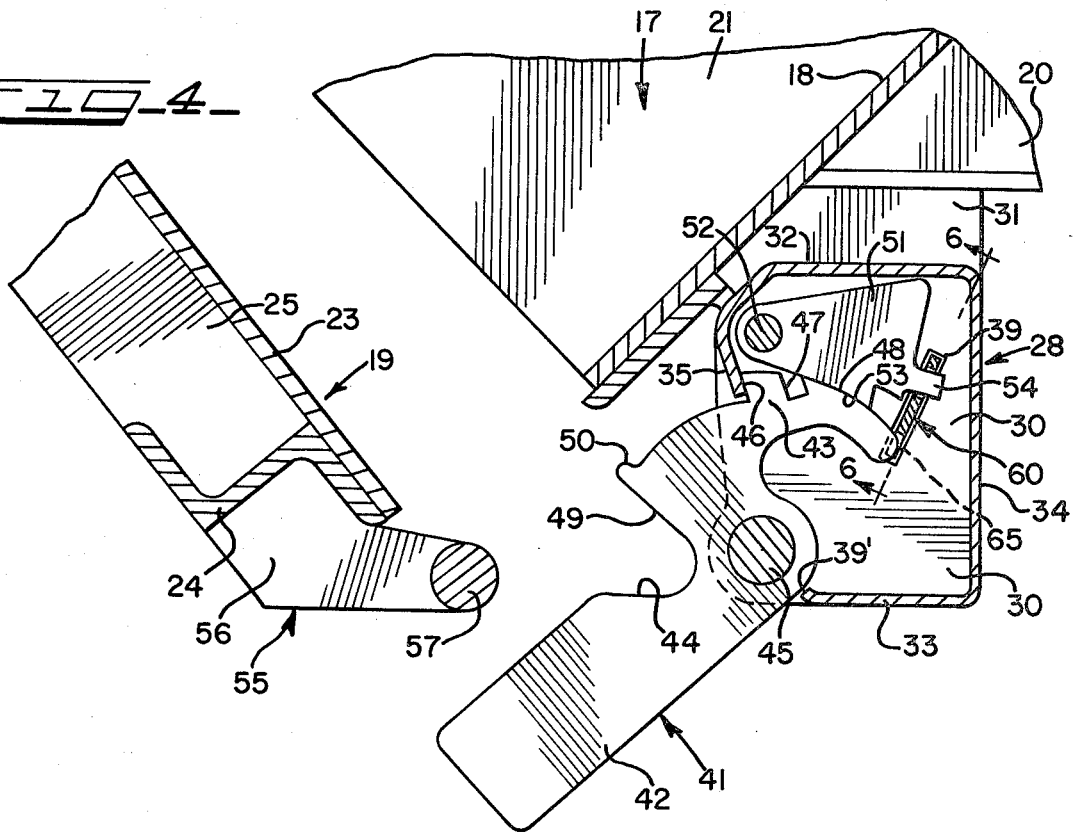
FIG. 4 is an enlarged view similar to FIG. 3 showing a release position of the latching mechanism.

As best shown in FIGS. 5 and 6, projecting laterally outwardly from the walls 30 on opposite sides thereof, are guide walls 36. The guide walls 36 are connected by means of upper walls 37 and lower walls 38. As best shown in FIGS. 4 and 6 the walls 36 provide a relatively narrow guide slot 39. The end of the walls 36 and 37 are provided with flange end members 40 suitably apertured to register with the relatively narrow guide slots 39.

The door locking mechanism 28 supports therein a latch member 41 which projects outwardly from the housing through an opening 39'. The latch member 41 includes a keeper receiving portion 42 at one end and is provided at its other end with a latch positioning portion 43. The keeper receiving portion includes a keeper engageable notch or socket 44. The latch member 41 is pivotally mounted as indicated at 45 to the housing 29. The latch positioning portion 43 includes a first undercut portion providing a stop 46 and includes a recessed or notched portion 47. The latch positioning portion 43 is in arcuate configuration as indicated at 48. As a continuation of the notch 44 a wall of the latch member 41 provides a projecting or abutment surface 49 which is provided at its upper end with a stop 50 limiting the rotation of the movement of the latch member in a clockwise direction to the position as indicated in FIG. 3. The wall 35 is engaged by the stop 50 during the clockwise movement of the latch member and is retained in the position as indicated against the wall 35. A locking element or pawl 51 is pivotally supported within the housing 29 by means of a pivot shaft 52. The lower edge of the pawl 51 has an arcuate surface 53 complemental to the surface 48 of the latch element. The pawl 51 includes an outwardly projecting cam element or tongue 54. Referring now particularly to FIG. 4 the door 19 is provided with a keeper generally designated at 55 consisting of a pair of spaced brackets 56 suitably supported on the Z-shaped member 24 and having connected thereto transversely extending cylindrical bar 57 which is adapted to engage the keeper notch 44 in locking engagement.

A latch actuating member is designated at 60 and is best shown in FIGS. 4, 5 and 6. The latch actuating member 60 is in the shape of a relatively flat plate which is reciprocably positioned within the narrow slot 39 formed by the walls 36, 37 and 38. The relatively thin plate actuating member 60 includes a cam cutout portion 61 having a lower cam surface 62 and an upper cam surface 63. The surfaces 62 and 63 are connected by an inclined cam surface 64. As best shown in FIGS. 5 and 6 the lower edges of the actuating member 60 also include an undercut portion providing a stop 65 the purpose of which will presently be described.

Figure 2:
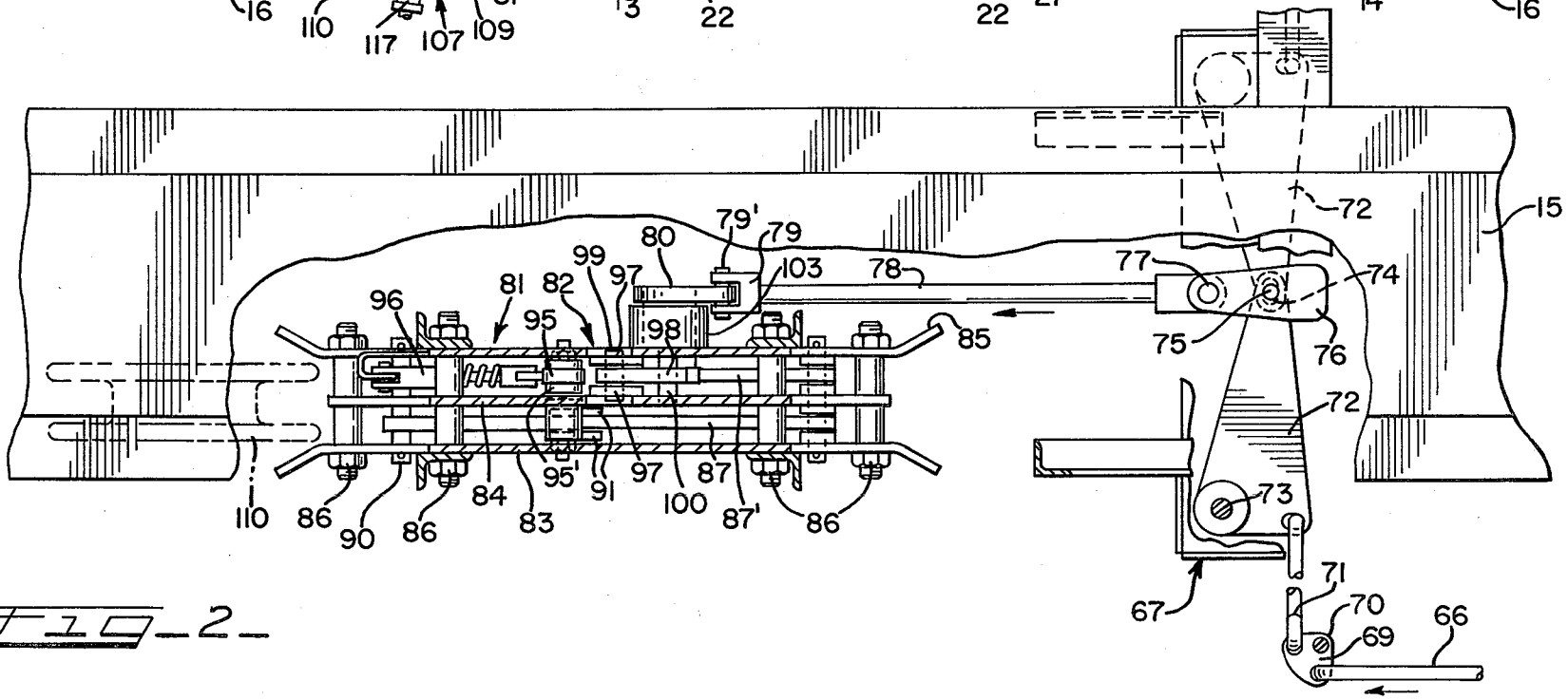
FIG. 2 is a cross-sectional view through a portion of a driven mechanism taken substantially along the line 2—2 of FIG. 1.

Actuating rods 66 are connected to opposite ends of the members 60 and provide for the reciprocation of the member as desired. Referring now particularly to FIG. 2 the actuating rod 66 is pivotally connected as indicated to a bell crank lever 69 suitably pivoted as indicated at 70 to portions of the underframe not disclosed in detail. The bell cranks 69 are in turn connected to a link 71 pivotally connected to an arm 72 which in turn is pivoted as indicated at 73 on a housing structure 67. The housing structure 67 is suitably connected to the underneath portion of the center sill. Only one of the door actuating mechanisms is described in detail. It is of course understood that, as shown in FIG. 2, another arm 72 is provided for actuating the linkage and locking mechanisms of the door on the other side of the car, four of such doors and mechanisms being provided. The arms 72 are pivotally interconnected as indicated by an elongated slot and pivot pin arrangement 75 to a clevis type member 76 in turn pivotally connected at 77 to an actuating push-pull rod 78. The push-pull rod 78 is provided at its end with a clevis 79 in turn connected by a pivot pin 79' to a rotating arm 80.

Figure 7:
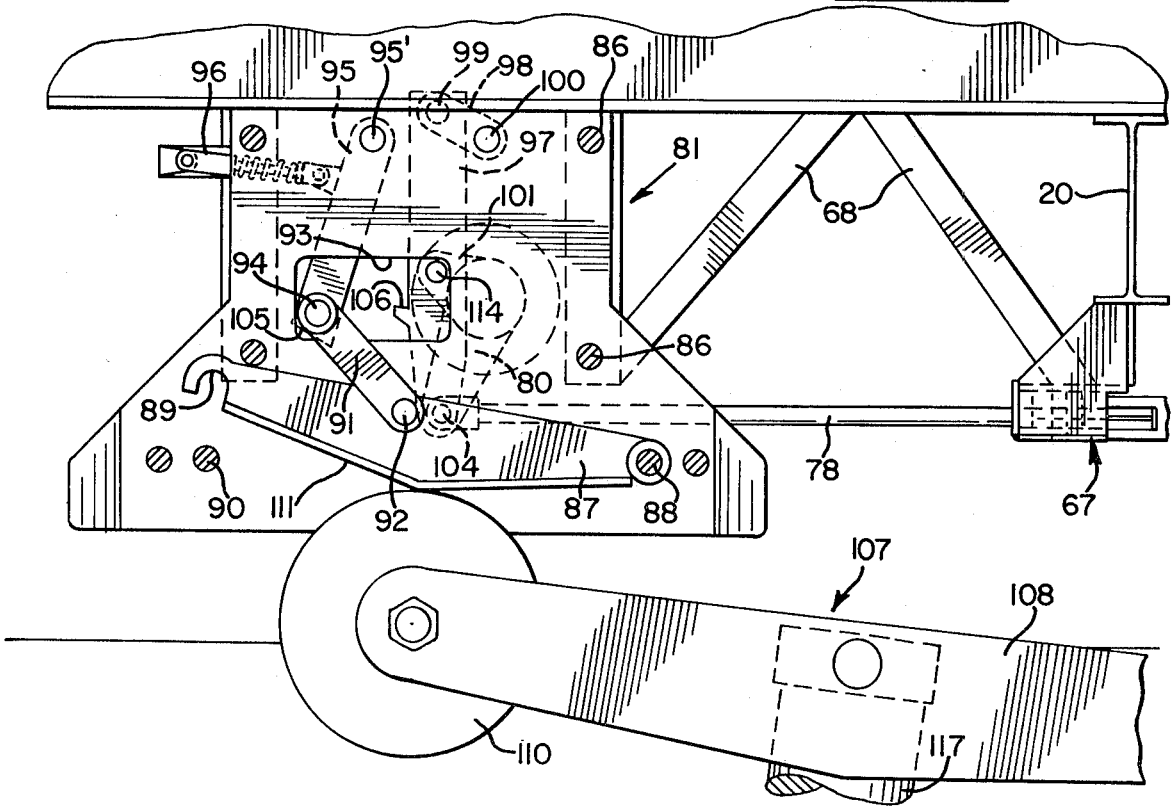
FIG. 7 is a side elevational view of a drive and driven mechanism supported on the underneath surface of a hopper car for actuating a door unlocking mechanism.
Figure 8:
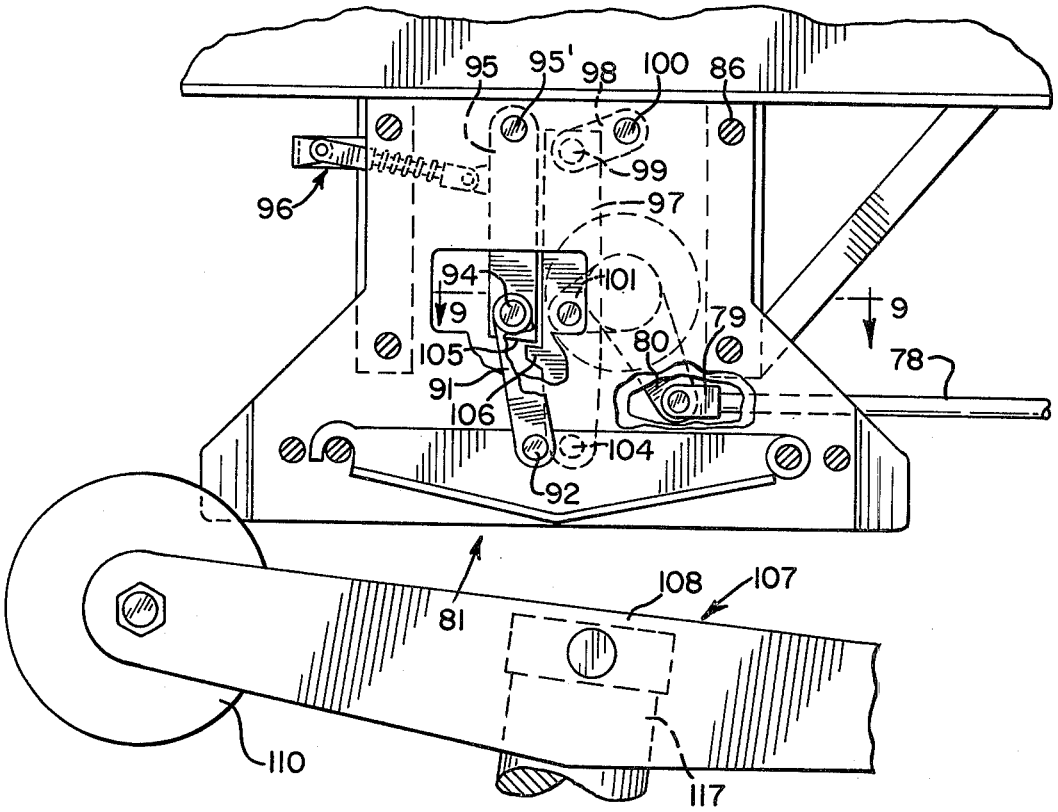
FIG. 8 is an enlarged view of FIG. 7 with portions broken away to better illustrate the invention.

Referring now particularly to FIGS. 2, 7, 8 and 9 the driven actuating mechanism is designated at 81 and includes a housing 82. The housing 82 is suitably supported on the underneath side of the center sill at one end of the car as best shown in FIG. 1. The housing 82 includes a plurality of vertical plates 83, 84 and 85 suitably interconnected by means of bolt and nut fasteners 86. An actuating arm or lever 87 is pivotally connected as indicated at 88 to the housing 82 and includes at its forward end a notch 89 adapted to engage a transverse pin 90 in resting position as best indicated in FIG. 8. A pair of links 91 are pivotally connected as indicated at 92 to the arm 87. The central plate 84 is provided with an opening 93 and a pivot connection 94 as best shown in FIG. 7 projects through the opening 93 and is connected to another link 95 which extends upwardly and is pivotally connected by means of a pin 95' to the plate 85. A spring mechanism 96 connected to the housing 82 continually urges the links 91 and 95 to assume a linear position.

Figure 9:
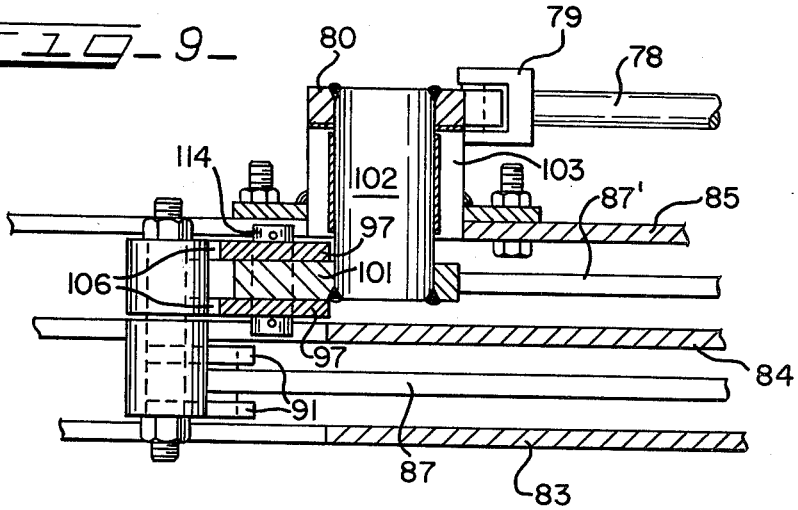
FIG. 9 is a cross-sectional view taken substantially along the line 9—9 of FIG. 8.

A vertically movable arm or link 97 is pivotally connected as indicated at 99 to a link 98 in turn pivotally connected as indicated at 100 to the plates 84 and 85. An arm 101 as best shown in FIG. 9 is connected to rotate a shaft 102 rotatably mounted in a bearing 103 suitably supported on the housing 82. The rotatable arm 80 is rigidly connected to the shaft 102 and provides for rotation thereof and thereby reciprocation of the link 78 through the clevis 79. As best shown in FIG. 9 the arm 97 is pivotally connected to an inner plate 87' of the actuating arm 87. As best shown in FIGS. 7 and 8 the lower end of the link 95 provides a stop surface 105 which is adapted to limit vertical movement or stop relative movement of the arm 97 by virtue of its engagement with the stop 106 provided on the said member 97. This is best shown in FIG. 8. FIG. 7 discloses the stop 105 removed from the path of movement of the stop 106. As best shown in FIGS. 7 and 8 the drive mechanism is generally designated at 107. The drive mechanism includes an arm 108 pivotally connected as indicated at 109, in FIG. 1, to a suitable support on the ground between the tracks of the car. The drive mechanism 107 includes at its forward end a roller 110 pivotally supported on the front end of the arm 108. And a fluid extensible device 117 is pivotally connected to the arm 108 and in response to suitable valving mechanism not shown under the operation of an operator the arm 108 may be lowered and raised as desired.

Operation

When the railway car arrives at its destination and the coal or other material within the hoppers is to be dumped through the railway tracks to a suitable bin usually disposed underneath the track, the car is placed into operating relation with respect to the drive mechanism 107. The driven mechanism is in the position shown in FIG. 8 and the car doors are still in closed position. The lever 87 is now pivoted upwardly by raising of the arm 108 and the wheel 110 into engagement with the camming surface 111 which thereupon moves the arms or vertical links 97 upwardly. The links 97 are free to move upwardly since the links 91 and 95 have assumed their jackknife position, shown in FIG. 7 whereupon the stop 105 has been moved out of the way of travel of the stops 106 provided on the links 97. The links 97 are connected to the arm 101 by means of a pivot pin 114 as best shown in FIG. 9. The arms or links 97 are moved upwardly in a vertical direction as controlled by the upper links 98. The shaft 102 is rotated in turn causing rotation of the link 80 and reciprocation or movement of the clevis 79 and connected links 78. Referring particularly to FIG. 8 the arm 80 is moved from the position shown to the position shown in FIG. 7 having moved the actuating rod 78 in the direction indicated. At this point the doors are still in the closed position of the locking mechanism disclosed in FIG. 3.

As the link 78 is moved in the direction of the arrow, the arm 72, as shown in FIG. 2 is pivoted whereupon the link 66 is also moved in the same direction in turn causing movement of the actuating member or plate 60 from the position shown in FIG. 5 to the position shown in FIG. 6. Upon initial movement of the plate 60 the stop 65 is disengaged from the recess stop 47 on the latch member positioning surface. The cam follower or tongue 54 has moved upwardly on the cam surfaces 62, 64 and 63 which means that the pawl 51 is now raised from its locking engagement with respect to the first stop 46 and the latch member 41 is now free to assume the position shown in FIG. 4 which is the open position.

The weight of the material riding on outermost surface of the notch 44 provides for the pivoting movement to the position indicated in FIG. 4 wherein the first stop 46 is now retained against the wall 35 in the open position as indicated. The complemental arcuate surface 48 moves along the complemental surface 43 in engaging relation and the pawl is maintained in this position shown in FIG. 4. The doors now are released and when the load has been discharged from the cars, the car is moved into operating relation with respect to the closing cam 113. The cam 113 is engaged by the cam followers 27 which then move the doors back to the closed position wherein the keeper elements 57 engage into notches 44 as they are closed. The abutting surface 49 is engaged and the latch members are swung to the position indicated in FIG. 3 wherein the parts again will assume their locked position as indicated in FIG. 3. Similarly the drive and driven mechanisms shown for actuating the rods 78 again assume their locked position as shown in FIG. 8. In this position the links 91 and 94 are again in linear relation and the stop 105 is in the path of movement of the spaced arms or links 97 which are maintained thus in a position against inadvertent opening providing additional locking means for keeping the doors in the locked position.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What is claimed is:

1. A railway hopper car comprising a car body including an underframe, a hopper structure supported on said underframe including downwardly and outwardly extending slope sheets and a discharge opening, a door hingedly connected to said car body for movement between open and closed positions relative to said opening, the improvement of a door lock arrangement comprising;

a lock support bracket connected to said hopper structure adjacent to said discharge opening, a latch member movably supported on said bracket between open and closed positions, said latch member having a latch positioning portion and a keeper receiving portion, a keeper element on said door adapted to engage said keeper receiving portion in the locked position of said door, first and second stop elements on said latch positioning portion, a locking element movably connected to said bracket adjacent to said latch positioning portion, said locking element in a closed position of said latch member having a third stop engaging said first stop element to maintain said latch member closed, a cam follower element on said locking element, a reciprocating actuating member supported on said bracket and including a cam engaging said cam follower, said reciprocating actuating member having a fourth stop in the closed position of said latch member engaging said second stop to maintain said latch member closed, and means for reciprocating said actuating member whereby said cam follower moves said locking element and first and third stops out of engagement, and said fourth stop is disengaged from said second stop, whereupon said latch member is moved to an open position releasing said keeper element.

2. The invention in accordance with claim 1, said lock support bracket being connected underneath said hopper structure, said latch member including a notch positioned between said keeper receiving portion and said positioning portion, said keeper element comprising a bar portion disposed in said notch in the closed position.

3. The invention in accordance with claim 1, including a fifth stop on said bracket engaging said first stop in the open position of said latch member.

4. The invention in accordance with claim 3, said latch member including a projection adjacent to said notch engageable by said keeper during closing movement of said door for rotating said latch member to said closed position.

5. The invention in accordance with claim 4, said locking element being pivotally supported on said bracket for clockwise and counter-clockwise movements.

6. The invention in accordance with claim 5, said reciprocating actuating member comprising a plate including an actuating link connected thereto, said cam including a cam slot having camming surfaces, said cam follower including a projecting tongue slidingly disposed in said slot.

7. The invention in accordance with claim 6, said means for reciprocating said actuating member including a linkage arrangement connected thereto, a driven mechanism on said car connected to said linkage mechanism, and ground positioned drive means for driving said driven mechanism.

8. The invention in accordance with claim 1, said means for reciprocating said actuating member including a driven mechanism carried on said car, and a drive mechanism supported on the ground for driving said driven mechanism.

9. The invention in accordance with claim 8, said means for reciprocating said actuating member further including linkage means connected to said actuating member and said driven mechanism, said driven mechanism including an arm pivotally supported on said car, a vertical link pivotally connected to said arm for vertical movement therewith; and a rotatable member connected to said vertical link, said rotatable member being connected to said linkage means for reciprocating the same, and said drive mechanism including means for pivoting said arm.

10. The invention in accordance with claim 9, including a lock means on said driven mechanism engaging said vertical link for locking the same against vertical movement in the absence of a force actuated by said drive mechanism for pivoting said arm.

* * * * *